US005309954A

United States Patent [19]

Franssen

[11] Patent Number: 5,309,954

[45] Date of Patent: May 10, 1994

[54] METHOD FOR FORMING WIRE EYES

[76] Inventor: Daniel J. Franssen, 6666 State Rd. BB, Washington, Mo. 63090

[21] Appl. No.: 938,717

[22] Filed: Sep. 1, 1992

[51] Int. Cl.[5] ..... B21F 1/06

[52] U.S. Cl. ..... 140/104; 7/107

[58] Field of Search ..... 7/107, 108; 140/104; 81/436, 437, 451

[56] References Cited

U.S. PATENT DOCUMENTS

| | | | |
|---|---|---|---|
| 3,253,286 | 5/1966 | Bacon | 7/108 |
| 4,060,305 | 11/1977 | Poliak et al. | 7/107 |
| 4,074,732 | 2/1978 | Wilkens | 7/107 |
| 4,257,159 | 3/1981 | Wingert | 7/108 |

*Primary Examiner*—Lowell A. Larson
*Assistant Examiner*—Thomas C. Schoeffler
*Attorney, Agent, or Firm*—Robbins & Robbins

[57] ABSTRACT

A tool and method for forming wire eyes in stiff wire are provided. The tool has a handle and a shank, or shaft, having a hollow or tubular opening at the end extending into the shank a selected distance corresponding to the length of the wire needed to form an initial bend in the wire. The end of the wire is inserted into the tubular opening and generally formed into a circular eye in two separate bending steps. A side opening or eye is provided in the shank adjacent the end to form a final bend in the wire to the wire eye which may be forcefully closed by pliers or the like.

3 Claims, 2 Drawing Sheets

METHOD FOR FORMING WIRE EYES

BACKGROUND OF THE INVENTION

In the past, in various aspects of electrical work wire ends in on the job applications are required to be bent in the field to the form of wire eyes. Such forming is needed in order to apply the wire eyes to stud terminals or the like, secured by nuts of one type or another to provide electrical connections. The usual tool employed in the field is a pair of pliers.

In some electrical work, such as railroad signal work, stiff copper wire is employed. Such wire, because of its stiffness is difficult to manipulate and form, particularly when numerous forming applications are needed in outdoor weather which may be harsh and inclement.

It has remained a problem to provide a simple tool which can be easily employed in the field to form wire eyes precisely formed at a stripped end of stiff insulated wire.

SUMMARY OF THE INVENTION

By means of this invention there has been provided a simple hand tool and method which may be employed to form wire eyes at the end of stiff wire of one type or another.

The tool is comprised of a handle and an elongated shank, or shaft, having a tubular opening at the end of the shank which extends into the shank a preselected distance to a solid portion of the shank which serves as a stop to limit insertion of a stripped end of the wire to be formed. The preselected distance is designed to provide a sufficient distance for forming a proper bend of the wire in the formation of the wire eye.

The tubular opening loosely receives the wire end and bending is effected simply by turning the tool to form bends in the initial formation of the wire eye to approximate a round loop which is fitted over a stud-like terminal in conventional fashion once formed.

A side opening or eye in the shank is provided adjacent the end which is of a size to receive loosely the end of the wire at a short distance from the end. The end is further twisted or bent to form the end of the wire to an eye or loop which may be finally closed if desired by pliers or the like.

The tool is rugged in construction and is readily employed in the field without any special training needed. Its low cost of manufacture and simplicity lends itself to a wide variety of wire eye forming applications in the field while reducing the physical labor and time required in former practices employing conventional tools, such as pliers.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 2:
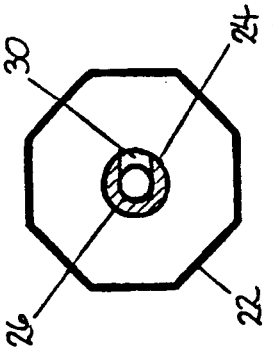
FIG. 2 is a view in section taken on line 2—2 of FIG. 1.

The hand tool of this invention is generally designated by the reference numeral 20 in FIGS. 1 through 10. It is comprised of a handle 22 and a shank 24 of steel or the like.

Figure 4:
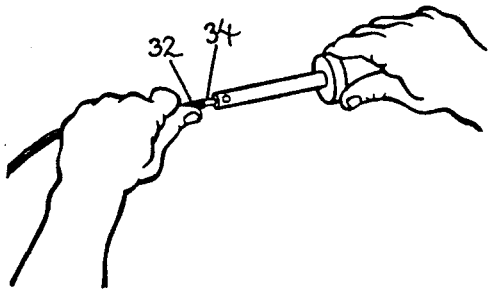
FIG. 4 is a pictorial view showing the first stage of use of the tool a wire eye.

The shank 24 has a tubular opening 26 extending into the shank a selected distance to a stop 28. The stop 28 is formed by a solid portion 29 of the shank 24 and limits the insertion of the stripped end of the wire as shown in FIG. 4, to be described to a distance to effect formation of a wire eye of the proper size. It will be understood that where desired, the tubular opening may be made of different inside diameters to receive loosely wire of different sizes and the tubular opening may extend into the shank to the stop 28, different selected distances to form wire eyes of different sizes. Thus, inserts having different inside diameters and different stop distances from the end, may be used in the tubular opening or different hand tools with the different dimensions, may be employed as desired.

For the purpose of example, using #6 stiff copper wire, the tubular opening may extend into the shank 1.45 inch and have an external diameter of 0.375 inch and an internal diameter of 0.125 inch. It will be understood that for different sized wire and different size wire eyes, these dimensions may be modified.

Figure 1:
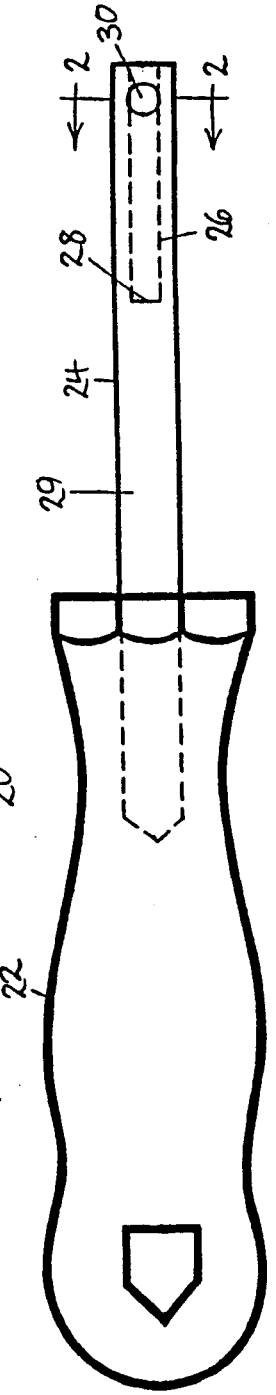
FIG. 1 is a view in side elevation of the tool.
Figure 3:
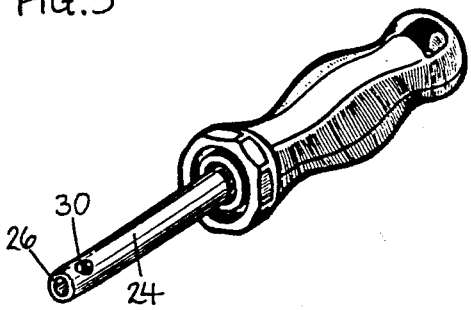
FIG. 3 is a pictorial view of the tool.

A side opening or eye 30 is best shown in FIGS. 1 and 2. It extends into the tubular opening 26, a short distance from the end of the shank and may be of the same diameter as that of the tubular opening.

USE

The method of use is best shown in FIGS. 3 through 10. The first step is stripping the end of wire 32 to form a stripped end 34, a sufficient distance to form the wire eye. The stripped end 32 is then fully inserted as shown in FIG. 4 into the tubular opening 26 against the stop 28.

Figure 5:
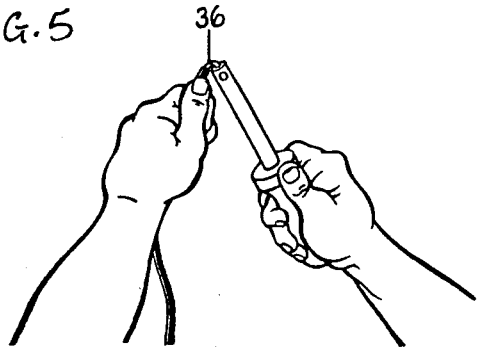
FIG. 5 is a pictorial view showing the next stage.

The next step is shown in FIG. 5 where a bend 36 is formed by bending the stripped end of the wire a slight distance past ninety degrees. The bend is formed at the proper position due to the selected distance of the stop 28 from the end of the shank and the positioning of the end of the wire against the stop.

Figure 6:
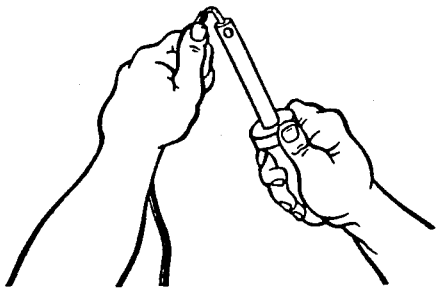
FIG. 6 is a pictorial view showing the next stage.
Figure 7:
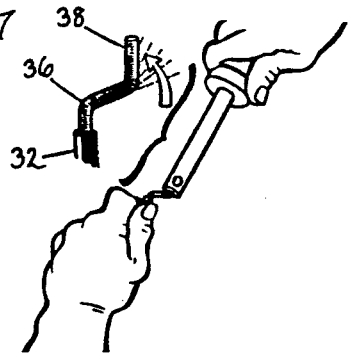
FIG. 7 is a pictorial view showing the next stage.

The next steps are shown in FIG. 6 where the tool is moved toward the end of the wire a slight distance of approximately one-quarter inch, and FIG. 7, where the wire is bent back until a second bend 38 of approximately ninety degrees is formed.

Figure 8:
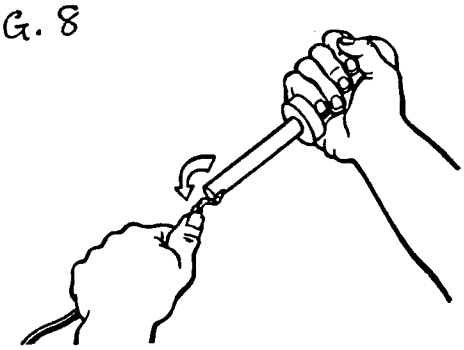
FIG. 8 is a pictorial view showing the next stage.
Figure 9:
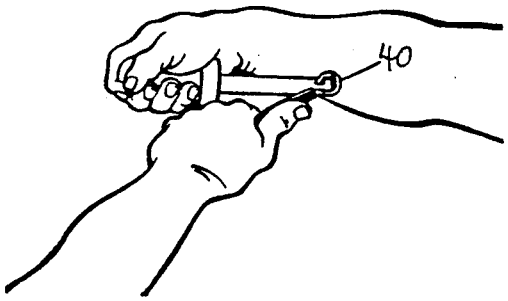
FIG. 9 is a pictorial view showing the next stage.

The end of the wire is then inserted as shown in FIG. 8 into the side opening or eye 30 at the end of the shank. The end of the wire is then bent around to form a circular loop 40 as shown in FIG. 9.

Figure 10:
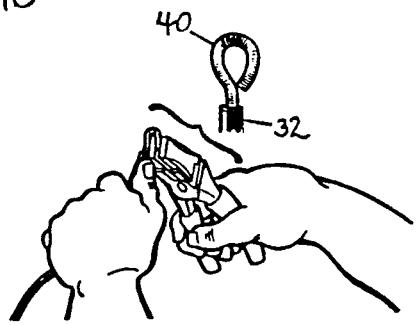
FIG. 10 is a pictorial view showing the last stage.

The loop may then be closed to finished form as desired in FIG. 10 by pliers or the like.

After forming the wire eye, it may be connected to terminals in the usual fashion with other wire connections as in the past. The tool and method of this invention are designed to enable the user to form simply and efficiently 10 wire eyes of proper size and location at the wire end with a minimum of effort and time.

Various changes and modifications may be made within this invention as will be apparent to those skilled in the art. Such changes and modifications are within the scope and teaching of this invention as defined in the claims appended hereto.

What is claimed is:

1. A method for forming an eye on a stripped end of a stiff insulated wire a selected distance from an end of insulation on said wire which comprises inserting the stripped end axially into an end opening of a tubular shank of a hand tool a preselected distance, bending said stripped end in the tubular shank by moving said tool while holding an end portion of said wire, said bending being effected by bending the wire at least ninety degrees, sliding the tool a slight distance toward the end of the wire and forming a second bend until a second substantially ninety degree bend is formed, inserting the bent end of said stripped wire into a side opening of said shank adjacent an end of the shank, both of said openings being of substantially the same size to receive loosely the stripped end of the wire, and forcefully bending said end of the stripped wire into the form of an eye.

2. The method of claim 1 in which the stripped end of the wire is inserted into the tubular shank against a stop in the shank and bending the wire a preselected distance from the end of the stripped wire, said preselected distance substantially equaling the length of wire required to form the wire eye.

3. The method of claim 1 in which the wire is stripped from the end a distance slightly greater than the distance of the stop from the end of said shank to form said eye close to the insulated end portion of said wire.

* * * * *